US008979613B2

(12) United States Patent
Moldovan et al.

(10) Patent No.: US 8,979,613 B2
(45) Date of Patent: Mar. 17, 2015

(54) NANO-FABRICATED STRUCTURED DIAMOND ABRASIVE ARTICLE

(75) Inventors: Nicolaie Moldovan, Plainfield, IL (US); John Carlisle, Plainfield, IL (US)

(73) Assignee: Advanced Diamond Technologies, Inc., Romeoville, IL (US)

( * ) Notice: Subject to any disclaimer, the term of this patent is extended or adjusted under 35 U.S.C. 154(b) by 1059 days.

(21) Appl. No.: 12/997,579

(22) PCT Filed: Jun. 10, 2009

(86) PCT No.: PCT/US2009/046960

§ 371 (c)(1), (2), (4) Date: Jun. 13, 2011

(87) PCT Pub. No.: WO2009/152278

PCT Pub. Date: Dec. 17, 2009

(65) Prior Publication Data

US 2011/0230127 A1 Sep. 22, 2011

Related U.S. Application Data

(60) Provisional application No. 61/060,717, filed on Jun. 11, 2008.

(51) Int. Cl.
*B24D 18/00* (2006.01)
*B24D 3/06* (2006.01)

(52) U.S. Cl.
CPC . *B24D 18/00* (2013.01); *B24D 3/06* (2013.01)
USPC ..... 451/56; 451/540; 51/295

(58) Field of Classification Search
CPC ..... B24B 41/00; B24D 3/00; B23B 9/00
USPC ..... 451/540, 41, 56, 443; 51/295, 297, 307
See application file for complete search history.

(56) References Cited

U.S. PATENT DOCUMENTS

| | | | | |
|---|---|---|---|---|
| 5,107,626 | A | 4/1992 | Mucci | |
| 5,152,279 | A | 10/1992 | Wilk | |
| 6,076,248 | A | 6/2000 | Hoopman et al. | |
| 6,632,127 | B1 * | 10/2003 | Zimmer et al. | 451/285 |
| 6,821,189 | B1 * | 11/2004 | Coad et al. | 451/41 |
| 7,008,855 | B2 | 3/2006 | Baney et al. | |
| 7,410,413 | B2 | 8/2008 | Woo et al. | |
| 2005/0148289 | A1 | 7/2005 | Mikolas et al. | |

OTHER PUBLICATIONS

Preliminary Report on Patentability in related application PCT/US2009/046960.

* cited by examiner

*Primary Examiner* — Robert Rose
(74) *Attorney, Agent, or Firm* — Locke Lord LLP; Christpoher J. Capelli

(57) ABSTRACT

The present invention describes a microfabricated or nanofabricated structured diamond abrasive with a high surface density array of geometrical protrusions of pyramidal, truncated pyramidal or other shape, of designed shapes, sizes and placements, which provides for improved conditioning of CMP polishing pads, or other abrasive roles. Three methods of fabricating the structured diamond abrasive are described: molding of diamond into an array of grooves of various shapes and sizes etched into Si or another substrate material, with subsequent transferal onto another substrate and removal of the Si; etching of an array of geometrical protrusions into a thick diamond layer, and depositing a thick diamond layer over a substrate pre-patterned (or pre-structured) with an array of geometrical protrusions of designed sizes, shapes and placements on the surface.

23 Claims, 6 Drawing Sheets

Figure 1a
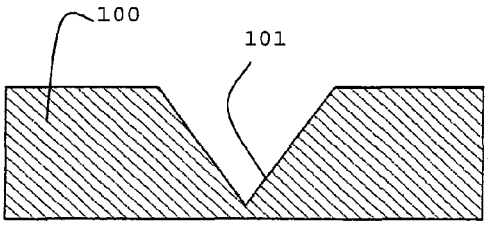
Figure 1b
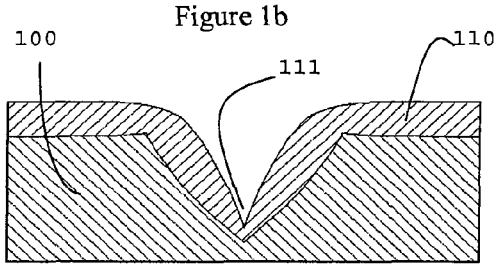
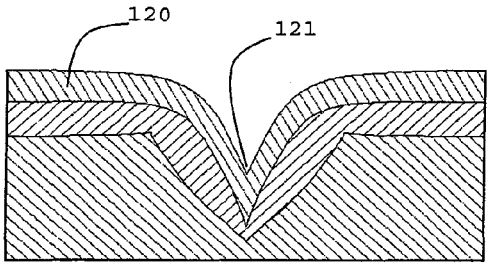
Figure 1c
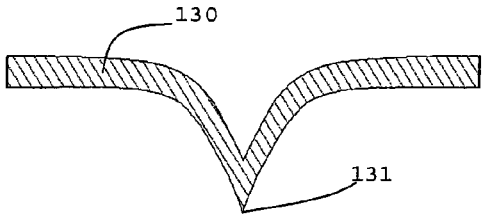
Figure 1d

NANO-FABRICATED STRUCTURED DIAMOND ABRASIVE ARTICLE

CROSS-REFERENCE TO RELATED APPLICATIONS

This application claims priority from U.S. Provisional Patent application Ser. No. 61/060,717 entitled "Nanofabricated Structured Diamond Abrasive Article", filed Jun. 11, 2008, which is incorporated herein by reference in its entirety.

TECHNICAL FIELD

Some embodiments are related to methods and an article for abrasion or conditioning of polishing pads and more particularly to methods of manufacture of precision microfabricated or nanofabricated diamond abrasive surfaces with designed placement of geometrical protrusions capable of generating abrasion of designed shape and size.

BACKGROUND OF THE INVENTION

Chemical Mechanical Polishing or Planarization (CMP) is a planarization method used in the semiconductor industry and in other industries such as the optical and flat panel polishing industries, which typically involves removal of material by a combination of relatively gentle abrasion of the layer being planarized (e.g. a Si wafer coated with a metal or dielectric layer) by a polishing pad (composed of a polymer or other relatively soft material) in the presence of a chemically active slurry. The slurry typically contains abrasive nanoparticles in colloidal suspension and a reactive chemical agent (e.g. an oxidizer, such as hydrogen peroxide for planarizing metal layers) whose reaction with the planarizing layer is facilitated by the mechanical action of the abrasive particles and a polishing pad typically designed in a particular structure or within a range of roughness. During the CMP process, the surface of the polishing pad may be gradually saturated with polishing nanoparticles, polishing debris and portions of abraded pad material, thus potentially increasing the contact area to an extent that modifies the removal rate of the planarizing material and/or increases the rate of defects of the planarization process through scratching of various sizes. In addition, the polishing pad surface can be abraded leading to a less controlled polishing process of the substrate being removed. Thus to perform a controlled and effective planarization process, these abrasive particles may need to be periodically removed from the polishing pad surface and the pad surface regenerated to a desired surface roughness and rate of defects. Such an action may be accomplished using a conditioning disk or CMP pad conditioner. Due to the hardness of typical abrasive particles and to increase its practical lifetime, the conditioning disk is often fabricated of a hard material, such as diamond. The uniformity and reproducibility of the CMP process often depends on the uniformity and reproducibility of the conditioning process.

Simple conditioning disks often use diamond grit (diamond particles of size from a few microns to a few tens of microns, selected by sieving though filters with different mesh sizes) incorporated into a metal layer (typically formed by electroplating). Such disks may have a Gaussian distribution of diamond particle sizes with a typical standard deviation of 15-20% of the maximum grit size. If, for a given applied force during the pad conditioning process, the penetration depth of the grit into the pad is less than 2-3 standard deviations of the grit height, a substantial number of grit particles (possibly less than 3%) may not touch the pad at all, thus leading to large variations in the uniformity of the pad conditioning process. Metal embedded diamond grit particles can also loosen and fall off, generating scratches or other defects on the substrates that are being planarized.

To overcome these problems and to lengthen effective work life, some conditioning disk manufacturers use CVD diamond to embed larger diamond particles, which are typically screened to reduce the distribution of their sizes. The extent of improvement can be measured, for example, by the number of wafers that can be processed with the same pad, which typically increases from 250 to 300 for the superior CVD diamond-embedded conditioners. However, for a range of applications, such as damascene and double damascene technologies, and as feature dimensions for silicon process technology continue to shrink in the sub-100 nm range, even such improved conditioning technology may still be prone to limitations imposed by irreproducibility in CMP removal rates and pad lifetime. Another issue with these embedded grit pads is that during the wear process of the conditioners, some of the embedded diamond particles may break or be dislodged. Since they might be quite large (e.g. 10-50 μm) hard diamond particles, they can be a significant source of defects on wafers as they are known to cause large scratches on polishing surfaces which can cause failure or reliability problems with surfaces polished by the pads being conditioned.

U.S. Pat. No. 6,076,248 describes a micro-structured surface with individually "sculpted" abrasive regions arranged in irregular arrays. It is primarily directed at the manufacture of a "master tool" for the preparation of other abrasives. It describes the individual sculpting of each abrasive region, i.e. many individual sculpting events. It does not describe a diamond abrasive structure (or diamond geometrical protrusion) covered surface.

U.S. Pat. No. 5,152,279 describes an abrasive surface with abrasive particles embedded in a surface in a roughly predetermined manner. U.S. Pat. No. 5,107,626 describes the method of using the abrasive article of U.S. Pat. No. 5,152,279 to provide a patterned surface. U.S. Pat. No. 6,821,189 describes a similar abrasive to the previous two patents but it also includes a diamond-like carbon coating. These patents do not discuss a method to tightly control the size and placement of the geometrical protrusions (sometimes referred to as "grit" in these various abrasive patents), on the surface.

US patent application 20050148289 describes CMP micromachining. It describes flexible polishing pads to aid in micromachining. Such polishing pads may benefit from embodiments presented here, both in terms of precision and in length of work life.

U.S. Pat. No. 7,410,413 describes another method of creating an abrasive article including the formation of "close-packed pyramidal-shaped composites". This abrasive patent discusses the mixing and formation of a composite of abrasives and a binder. This patent does not describe the exact placement of each geometrical protrusion. Neither does it describe methods to select in advance or design a placement location, shape and size for each geometrical protrusion.

SUMMARY

Some methods described herein are designed to produce precision microfabricated or nanofabricated abrasive articles or polish pad conditioners. Such abrasive articles include a plurality of raised geometrical protrusions which produce abrasive action or material removal when placed into contact with a target surface with a given downward force and move in relation to the target surface. In some embodiments, the plurality of geometrical protrusions are preselected (or designed) for a specific sizes, shapes and placements on an abrasive article substrate. The geometrical protrusions are placed on the abrasive article substrate surface in tightly controlled placements and therefore it is possible to design or specify a series of protrusion placements that are highly regular to produce highly controlled abrasive action or more predictable removal rates.

In some embodiments, micro-fabricated (or nano-fabricated) conditioning disks or substrates with extremely narrow and carefully designed "grit" (i.e. geometrical protrusion) size distributions and shapes can be used. Some embodiments describe methods of fabricating such conditioners or structured abrasive articles. Such embodiments may comprise arrays of diamond tips, posts or other geometrical protrusions of well-controlled and designed geometry and distribution/placement across a disk or substrate surface. Such disks may combine the durable and monolithic nature of a diamond abrasive surface which impedes the loss of grit "particles" (abrasive structures or geometrical protrusions made of or coated with diamond), with ultra-narrow height distribution or controlled size distribution and placement of grit particles/geometrical protrusions. The geometry and surface density of the diamond spikes/geometrical protrusions can also be very well controlled and optimized, with negligible variation from conditioning disk to conditioning disk or from precision abrasive surface to precision abrasive surface.

Such structured diamond abrasives of predetermined size and shape can also be used in other applications requiring precision, reproducibility and long work-life. Such applications include, for example, the precision manufacture of other abrasives, precisely controlled nano-abrasion of surfaces (e.g. hard-drive rigid-disk surfaces, optical surfaces, MEMS structures, and aerodynamic/hydrodynamic surfaces of low drag coefficient).

BRIEF DESCRIPTION OF DRAWINGS

In the drawings, identical or corresponding elements in the different Figures have the same reference numeral.

The invention is described by the following detailed description and drawings wherein:

FIG. 1. Diamond molding process for the production of precision abrasive articles or conditioners.

DETAILED DESCRIPTION

Figures 2A, 2B, 2C, 2D, 2E:
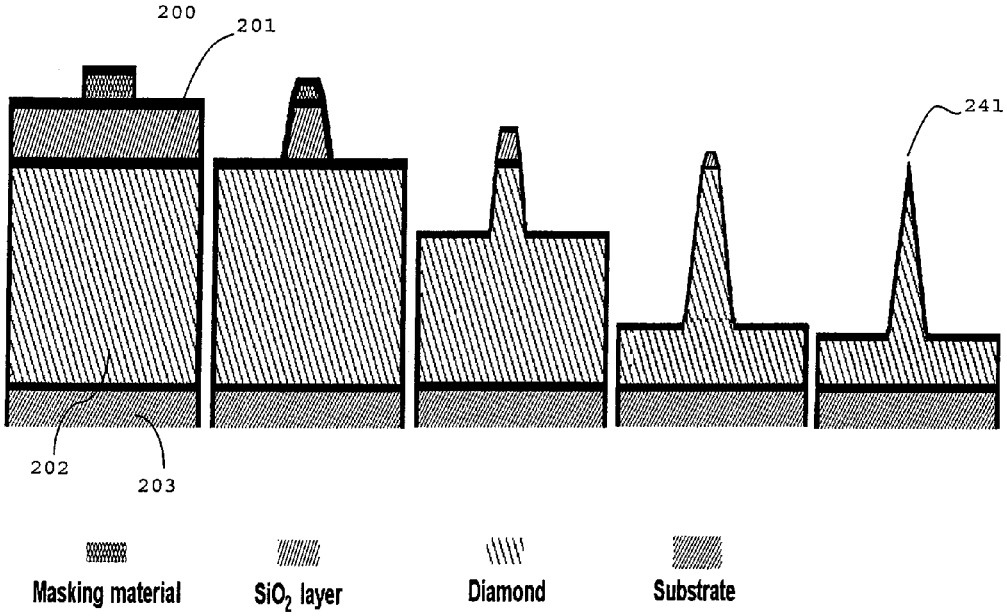
FIG. 2. Fabrication of arrays of diamond spikes/geometrical protrusions for a conditioning disk or other abrasive article, using hard-mask etching of a thick diamond layer according to the 2nd embodiment of the invention.
Figure 3A:
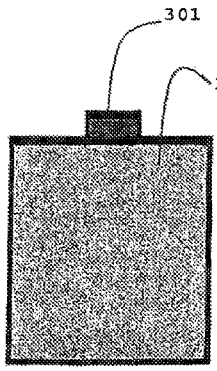
FIG. 3. Fabrication of diamond-coated arrays of tips or geometrical protrusions for conditioning CMP disks according to 3rd embodiment of the invention.
Figure 3B:
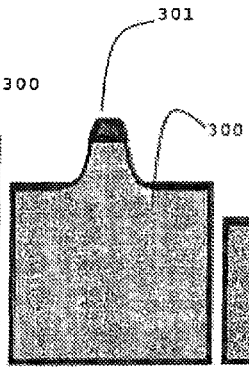
Figure 3C:
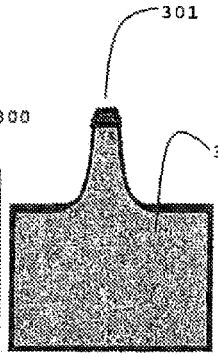
Figure 3D:
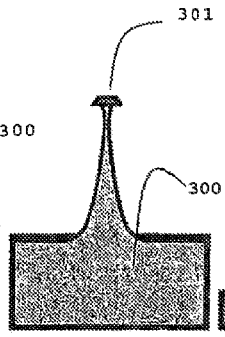
Figure 3E:
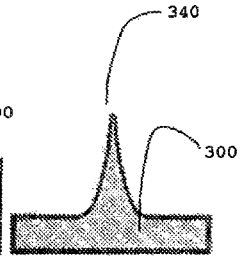
Figure 3F:
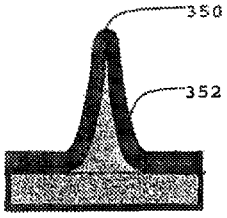

FIG. 1 depicts a diamond molding process for the production of precision abrasive articles or conditioners. In FIG. 1*a*, an exemplary Si substrate 100 is patterned with crystallographic wet etching to form wedges 101. FIG. 1*b* shows an additional step for the formation of a sharpened mold. In this case, the thermal oxide 110 is grown inside the mold 101 and on the substrate 100 surface outside the mold. The resulting surface comprises a sharpened point 111. FIG. 1*c* shows the deposition of a diamond layer 120 into the sharpened mold or groove area. The molded diamond material forms a sharp tip 121. FIG. 1*d* shows a final step to remove both the substrate material 100 and the thermal oxide 101 leaving the released molded diamond material 130 with a sharpened point 131.

FIG. 2 depicts fabrication of arrays of diamond spikes/geometrical protrusions for a conditioning disk or other abrasive article, using hard-mask etching of a thick diamond layer. FIG. 2*a* depicts a photoresist cap 200; a masking layer 201 comprising $SiO_2$; a diamond layer 202, and a silicon substrate 203. FIG. 2*b* depicts etching of the masking layer, with some erosion of the photoresist cap. FIGS. 2*c-e* depict etching of the diamond layer, with the formation of a sharp tip 241.

FIG. 3 depicts fabrication of diamond-coated arrays of tips or geometrical protrusions for conditioning CMP disks. FIG. 3*a* depicts a silicon substrate 300 with a photoresist layer 301 comprising $SiO_2$ disposed thereon. FIGS. 3*b*-3*d* depict etching by, for example, wet chemical etching, reactive ion etching, or the like. FIG. 3*e* depicts formation of a sharp tip 340.

Figure 4A:
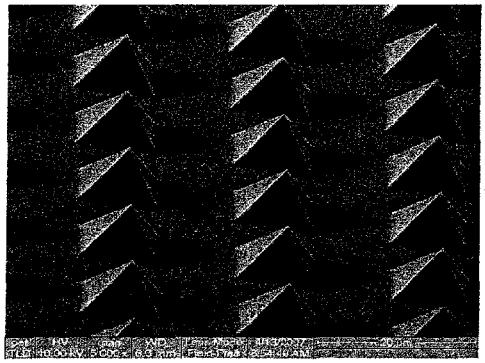
FIG. 4. Array of diamond pyramids formed using a method according to a 1st embodiment of the invention FIG. 5. Diamond abrasive geometrical protrusions formed according to the 3rd embodiment of the invention.
Figure 4B:
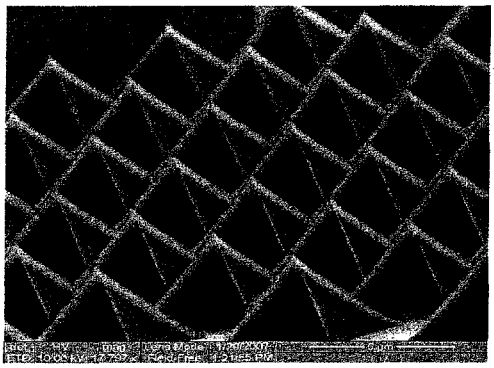

FIG. 4 depicts an array of diamond pyramids. FIG. 4*a* depicts an array of ultrananocrystalline diamond pyramids with four sides. Pyramid heights are approximately 7 μm. Pyramid density is approximately 250,000 protrusions per square centimeter. In FIG. 4*b*, pyramid heights are approximately 2.8 μm. Pyramid density is approximately 2,777,777 protrusions per square centimeter.

Figure 5:
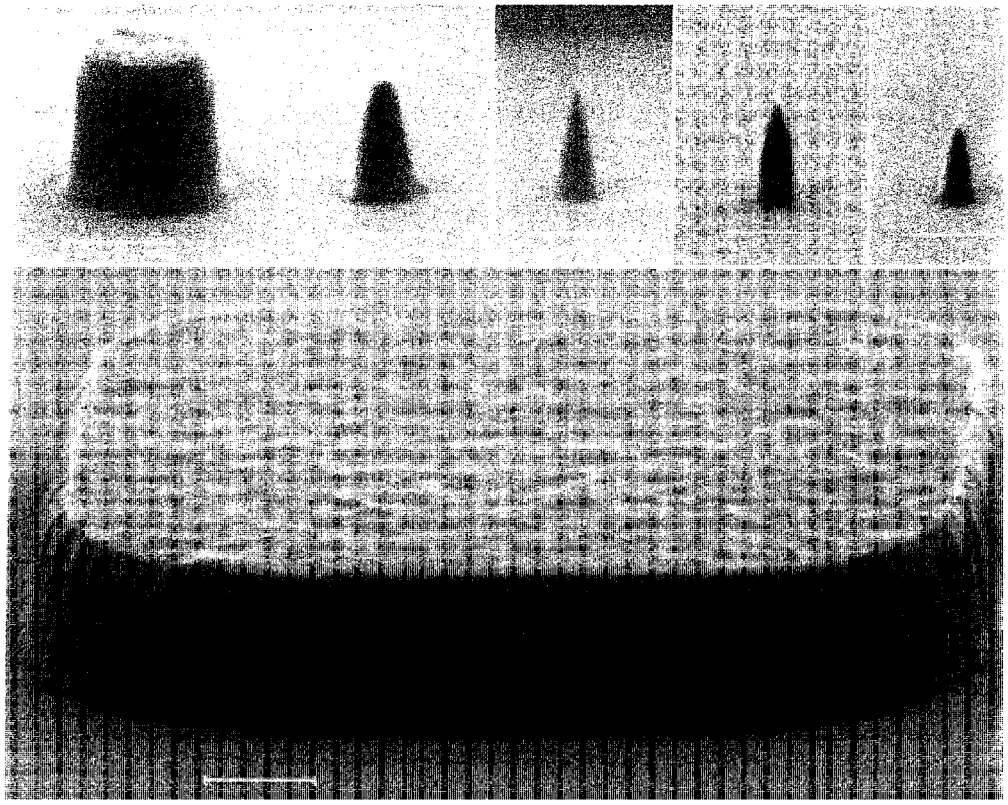

FIG. 5 depicts diamond abrasive geometrical protrusions. Scale bar denotes 1 μm. UNCD spike heights range from below 1 μm to approximately 2 μm.

Figures 6A, 6B, 6C, 6D:
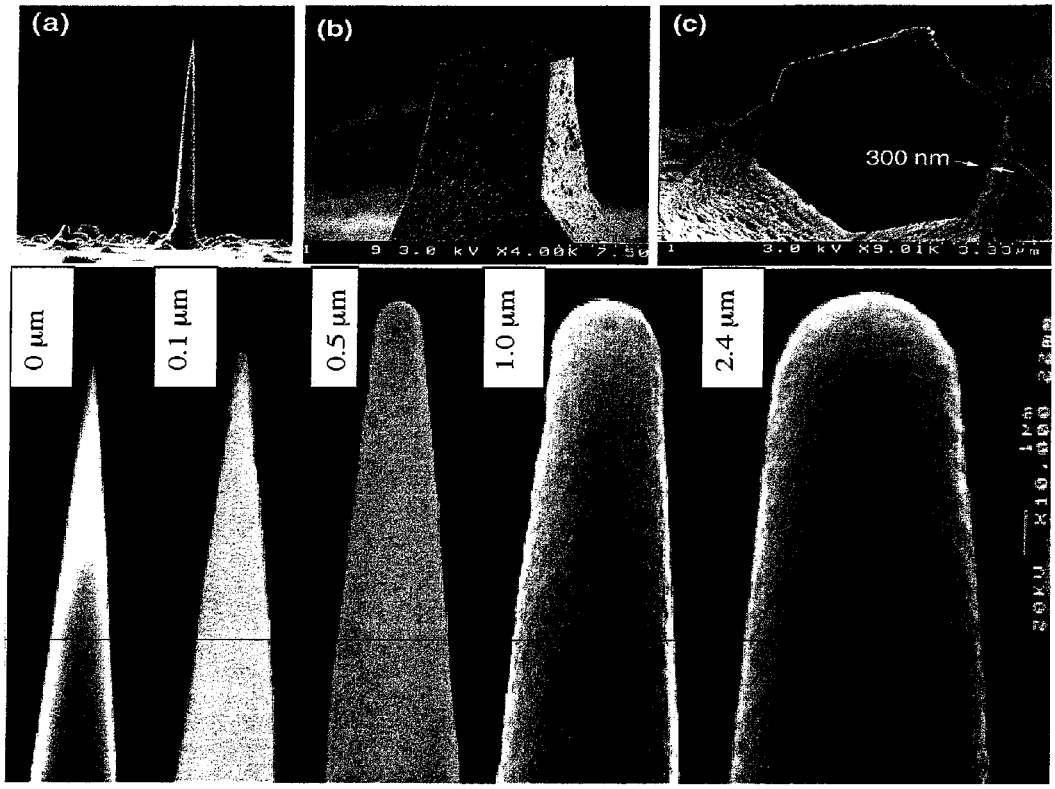
FIG. 6. Geometrical protrusions for an abrasive article formed according to a 3rd embodiment of the invention.

FIG. 6 depicts various geometrical protrusions for an abrasive article. FIG. 6*a* depicts an UNCD-coated Si microtip. In FIG. 6*b*, the structure of FIG. 6*a* has had its tip removed and the Si core of the structure has been etched by a HF-$HNO_3$ solution. FIG. 6*c* is a top view of the structure of FIG. 6*b*, showing the conformal nature of the approximately 300 nm thick coating. FIG. 6*d* depicts a series of UNCD-coated Si tips, with coating thicknesses ranging from approximately 0.1 μm to 2.4 μm. FIG. 6 is taken from N. Moldovan, O. Auciello, A. V. Sumant, J. A. Carlisle, R. Divan, D. M. Gruen, A. R. Krauss, D. C. Mancini, A. Jayatissa, and J. Tucek, *Micromachining of Ultrananocrystalline Diamond*, Proc. of SPIE 2001 International Symposium on Micromachining and Microfabrication, 22-25 Oct. 2001, San Francisco, Vol. 4557, pp. 288-298.

A first embodiment comprises starting with a Si wafer substrate, followed by $SiO_2$ growth (e.g. ~0.3 μm) by thermal oxidation, followed by lithographic patterning and crystallographic wet etching of the exposed substrate surface with square or circular windows of size ~2 to 30 μm (and preferably of size 5-20 μm, e.g. 14 μm), in regularly-spaced patterns or assembly to produce a desired density of spikes/geometrical protrusions (e.g. ~300,000/$cm^2$). However, any desired pattern can be designed into the lithographic step to produce an essentially unlimited range of possible arrangements and designed structure placements, sizes and shapes. The $SiO_2$ is then removed by buffered HF or oxide CMP. Optionally, a seeding enhancement layer (such as 50 nm of sputtered W) can be deposited before diamond deposition. Seeding with a suspension of diamond nanoparticles (prepared, e.g., by ultrasonication and rinsing, with detonation diamond powder dissolved in methanol, or with ultra-dispersed diamond—UDD solution) is performed, then diamond growth is performed by CVD (for illustration and not for limitation, UNCD is deposited by HFCVD) to a thickness of 2-20 μm (more preferably 5-10 μm). A $SiO_2$ layer (preferably BPSG) is then deposited by CVD in a thickness to fully fill the pyramids (12 μm for the typical case of 10-μm-deep V-groves generated by the previously-mentioned typical window size of 14 μm), then polished by CMP for planarization. Glass frit bonding is then performed, for example by following the method of U.S. Pat. No. 7,008,855 to Baney et al., using a low melting temperature glass, e.g. Paste FX 11-036, produced by Ferro Corporation, deposited onto the substrate by screen printing followed by thermal conditioning for 30 min at 500° C. in a nitrogen atmosphere. The preferred bonding substrate is a highly planar ceramic substrate. The bonding itself can be performed without microscope alignment (only visual alignment, to overlap the two plates). Following the bonding process, the Si mold-wafer is then removed by Tetra-Methyl Ammonium Hydroxide (TMAH).

Abrasive structure (geometrical protrusions) sizes and shapes are dependent on the particular application or material being abraded. However, for abrasive purposes, a geometrical protrusion height of about 0.1-500 μm, or more preferably about 1.0-50 μm is desirable. The amount of downward force applicable to a given surface to generate abrasion from the abrasive articles manufactured using this method are dependent upon the material being abraded and the designed size, shape, uniformity and placement of the geometrical protrusions on the surface, however a downward force of at least about 0.5 psi (~3.45 kPa), is preferred to generate a reasonable removal rate. Material removal rates of at least about 1 μm per hour are preferred and rates of at least about 100 μm per hour are more preferable, but this will depend upon the amount of downward force applied and the designed sizes, shapes and placements of the geometrical protrusions.

As a variant of this embodiment, it is possible to form "desharpened" protrusions using the method described above. Instead of depositing a material comprising diamond on top of the $SiO_2$, some oxide is instead first removed. Diamond is thereafter deposited to produce structures with desharpened points.

A second embodiment comprises direct etching (or forming) of spikes/geometrical protrusions into a thick diamond layer, for example from a thick UNCD layer (e.g. ~15 μm) deposited by HFCVD onto a planar ceramic or silicon substrate. This is followed by: a piranha clean of the UNCD layer (which also has as a goal to modify the hydrogen termination on the diamond surface into an oxide (—O) or a hydroxyl (—OH) termination which can provide for enhanced adhesion with a metallic or hydrophylic materials; deposition by PECVD of a $SiO_2$ layer (e.g. ~1.5 μm); CMP planarization (e.g. with a Cabot Microelectronics SS12 slurry and a Rohm and Haas, IC 1000 polishing pad, under 20 psi downward force polishing pressure) by removing ~1 μm of the $SiO_2$, to leave behind a smooth, planar surface of $SiO_2$, acceptable for lithography. This film is then patterned lithographically and etched (e.g. with $CHF_3$—$O_2$ reactive ion etching) into an array of square islands, (e.g. ~4 μm in size), then the pattern is transferred into UNCD to a depth of ~12 μm using a $O_2$—$CF_4$ Inductively Coupled Plasma-Reactive Ion Etch (ICP-RIE) plasma etch (typical ICP-RIE conditions: 50 sccm $O_2$, 2 sccm $CF_4$, 3 kW ICP, 5 W RIB). The degree of isotropy of the etch can be controlled by controlling the temperature of the substrate (e.g. ~400° C.) to vary the aspect ratio and depth of the spikes/geometrical protrusions until the $SiO_2$ cap falls off, leaving behind a sharpened diamond tip. Typical desired surface densities of spikes/geometrical protrusions for this method are 1,500,000/$cm^2$. If the structures are designed in a larger size (e.g. >20 μm or a width greater than the thickness of the deposited diamond) which do not etch laterally in an amount sufficient to remove the $SiO_2$ cap, then the height of the geometrical protrusions above the substrate in the resultant abrasive array will be approximately equal to the thickness of the diamond as deposited. If the designed size of the geometrical protrusions is small enough or significantly smaller than the thickness of the diamond layer (e.g. 4 μm for the initial dimension of the structures compared to 12 μm for the diamond layer thickness as in the example above) to allow the removal of the $SiO_2$ cap, then the resultant height of the geometrical protrusions (or spikes) will be dependent on the amount of over-etching and in the original designed size of the cap. In general, for these smaller structures (e.g. smaller than the thickness of the deposited diamond), the height of the resultant protrusion above the substrate surface will be less for the smaller structures since they will on average receive more over-etching. The larger structures will tend to be taller and the smaller structure shorter (see for example FIG. 5).

Abrasive structure (geometrical protrusions) sizes and shapes are dependent on the particular application or material being abraded. However, for abrasive purposes the preferred heights of protrusions are similar to those of the previous fabrication method, i.e. a geometrical protrusion height of about 0.1-500 or more preferably about 1.0-50 μm is desirable. The amount of downward force applicable to a given surface to generate abrasion from the abrasive articles manufactured using this method are dependent upon the material being abraded and the designed size, shape, uniformity and placement of the geometrical protrusions on the surface, however a downward force of at least about 0.5 psi (~3.45 kPa), is preferred to generate a reasonable removal rate. Material removal rates of at least about 1 μm per hour are preferred and rates of at least about 100 μm per hour are more preferable, but this will depend upon the downward force applied and the designed sizes, shapes and placements of the geometrical protrusions.

A third embodiment comprises preparing an etched or fabricated of Si or other patternable substrate to form spikes/geometrical protrusions that may then be covered with a diamond film or layer. For example, a Si wafer may be covered with a layer of thermal oxide, e.g. ~0.5 μm in thickness, or a layer of CVD oxide or nitride or other materials that are resistant to an etch chemistry used to etch silicon. The oxide (or alternative material resistant to silicon etch) may then be patterned into an array of square (or other desired shape) islands, each of them being e.g. ~6 μm×6 μm in size, by wet etching, with a buffered HF etch, $NH_4F$:HF 1:6, through a photoresist mask. The Si may then be etched with a $SF_6/O_2$ plasma Reactive Ion Etch (RIE) (e.g. 50 sccm $SF_6$, 5 sccm $O_2$, 200 mTorr, 200W) having a slightly isotropic etching nature. The degree of anisotropy may vary from one piece of equipment to another, and depends upon, for example, the plate area and the surface area being etched. Etching may then be performed until the $SiO_2$ cap is attached to the so-formed Si pyramid at a spot of diameter or width of ~2 μm (i.e. ~4 μm of the original ~6 μm width has been etch away. After this, etching may be continued by a $XeF_2$ isotropic etch until all the $SiO_2$ is removed and the caps fall off. The spikes/geometrical protrusions in Si obtained through use of this method may have a height of ~6 μm. A preferred surface spike/geometrical protrusions density range for this method can be about 10,000 protrusions/$cm^2$ to about 10,000,000 protrusions/$cm^2$ in or more preferably about 1,000,000 protrusions/$cm^2$.

Abrasive structure (geometrical protrusions) sizes and shapes are dependent on the particular application or material being abraded. However, for abrasive purposes the preferred heights of protrusions are similar to those of the previous fabrication method, i.e. a geometrical protrusion height of about 0.1-500 μm, or more preferably about 1.0-50 μm is desirable. The downward force applicable to a given surface to generate abrasion from the abrasive articles manufactured using this method are dependent upon the material being abraded and the designed size, shape, uniformity and placement of the geometrical protrusions on the surface, however a downward force of at least about 0.5 psi (~3.45 kPa), is preferred to generate a reasonable removal rate. Material removal rates of at least about 1 μm per hour are preferred and rates of at least about 100 μm per hour are more preferable, but this will depend upon the downward force applied and the designed sizes, shapes and placements of the geometrical protrusions.

Various shapes capable of abrading a surface can be designed with these fabrication methods. However, one preferred set of shapes than can be used to great effect and that provide strength and relative ease of design, is that of 3, 4, 5, or 6-sided pyramids with relatively sharp tips or 3, 4, 5, or 6-sided truncated pyramids with relatively flat tops. Other types of geometrical protrusions can be advantageous, including cones with substantially circular or elliptical bases and sharpened points.

The precision microfabricated conditioners or abrasive articles made using the methods described above, can be designed with specific arrangements of geometrical protrusions to select particular abrasive properties. For example, if elongated geometrical protrusions in the shape of lines or "fences" (or similar structures with one dimension longer than another at the exposed edge, or highest point of the protrusion) are all aligned on the abrasive article surface the abrasive properties generated from this arrangement can be substantially different depending upon whether or not they are used to abrade a surface along the axis of the protrusion lines or at an angle with respect to the axis of the protrusion lines. It may be advantageous to abrade a pad surface with such lines of abrasive protrusions at approximately right angles to the motion of a pad surface underneath the protrusions.

The above-mentioned embodiments can be used to form structures for abrasion including CMP conditioning heads or other precision abrasives or for alternative applications. An example of an alternative application for these assemblies of microfabricated structures is in the area of stamping or manufacturing of articles that are pressed into a desired shape using a stamping press or mold. Such manufacturing methods are commonly used in the automotive and consumer products industries to stamp metallic and polymeric materials into desired shapes. Elevated temperatures are sometimes used to soften the target material and facilitate the stamping process. The hardness and temperature range of diamond materials and the small microstructured size of the structures created using the method described above, raises the possibility of using these designed assembly of structures to form metallic or polymeric materials into desired shapes at the micron or nanometer scale. It is therefore possible that these methods may lead to quick and inexpensive manufacturing methods for MEMS (Micro-Electro-Mechanical Systems) and NEMS (Nano-Electro-Mechanical Systems) using assemblies of diamond structures formed using the methods described herein. The range of structure heights for these may be broader than for abrasive applications. One possible range of heights of the structures for MEMS and NEMS applications would be ~0.1 μm to 10 μm while for larger scale applications such as consumer products, a range of 1 μm to as much as 5 mm (5000 μm) may be desirable.

Another advantage of the methods of creating abrasive articles or conditioners with the methods described herein with ultrananocrystalline diamond (UNCD) of average grain size ~2-5 nm, is that abrasive wear of the surface tends to cause failure along grain boundaries and to dislodge individual debris particles of a size approximately equal to the average grain size. Since the average grain size here can be very small (~2-5 nm), preferably less than 100 nm, and more preferably less than 10 nm, and most abrasive applications are at larger dimensions, these dislodged grain debris are usually too small to cause damage or defects on such surfaces (e.g. scratches or gouges). Larger grain size diamond tends to dislodge under abrasive wear conditions with much larger debris size which are more likely to cause scratches or gouges of a size approximately equal to the size of the particle. Large grain size diamond films, e.g. microcrystalline diamond, grain size can be as high as 1-10 μm. The resultant scratches or defects would therefore be several orders of magnitude larger and be of much greater concern to a precision abrasive manufacturing process.

Although embodiments have been described and illustrated in detail, it is to be clearly understood that the same is by way of illustration and example only and not to be taken by way of limitation, the scope of the present invention being limited only by the appended claims.

What is claimed:

1. A method comprising:

providing a substrate comprising a first surface and a second surface; selecting at least one first size, at least one first shape, and at least one first location on said first surface;

providing at least one mold on said first surface, said at least one mold comprising at least one second size, said at least one second shape, and said at least on second location on said first surface, wherein said at least one second size is the same as said at least one first size, said at least one second shape is the same as said at least one first shape, and said at least one second location is the same as said at least one first location;

depositing a first layer comprising diamond on said first surface, said layer at least partially filling said at least one mold;

removing at least a portion of said mold;

adhering a second layer to said second surface;

wherein at least one of said at least one first size, at least one first shape, and at least one first location on said first surface is selected to provide a desired abrasion rate.

2. The method according to claim 1, wherein said substrate comprises silicon, tungsten, or titanium.

3. The method according to claim 1, wherein said first layer comprises ultrananocrystalline diamond.

4. The method according to claim 1, wherein said first layer diamond further comprises an average grain size less than 100 nm.

5. The method according to claim 1, wherein said depositing a first layer comprises hot filament chemical vapor deposition.

6. The method according to claim 1, wherein said providing at least one mold comprises etching.

7. The method according to claim 1, wherein said providing at least one mold comprises etching, said etching comprising a crystal orientation dependent etchant.

8. The method according to claim 6, wherein said providing at least one mold further comprises oxidation.

9. The method according to claim 1, wherein said first layer comprises at least one height from said first surface, said at least one height ranging from 0.1 μm to 5000 μm.

10. The method according to claim 1, wherein said first layer comprises at least one height from said first surface, said at least one height ranging from 0.1 μm to 500 μm.

11. The method according to claim 1, wherein said first layer comprises at least one height from said first surface, said at least one height ranging from 1 μm to 50 μm.

12. The method according to claim 1, wherein said first layer comprises at least one pyramid, said at least one pyramid comprising three sides or four sides or five sides or six sides.

13. The method according to claim 1, wherein said first layer comprises at least one rounded island comprising substantially flat tops.

14. A method comprising:

providing a substrate comprising a first surface and a second surface;

selecting at least one first size, at least one first shape, and at least one first location on said first surface;

depositing a first layer comprising diamond on said first surface; and patterning said first layer to form at least one protrusion comprising at least one second size, at least one second shape, and at least one second location on said first surface, wherein said at least one second size is the same as said at least one first size, said at least one second shape is the same as said at least one first shape, and said at least one second location is the same as said at least one first location;

wherein at least one of said at least one first size, at least one first shape, and at least one first location on said first surface is selected to provide a desired abrasion rate.

15. The method according to claim 14, further comprising adhering a second layer to said second surface.

16. The method according to claim 14, further comprising depositing a second layer on said first layer, said second layer comprising silicon oxide.

17. The method according to claim 14, wherein said substrate comprises silicon.

18. The method according to claim 14, wherein said first layer comprises ultrananocrystalline diamond.

19. The method according to claim 14, wherein said first layer diamond further comprises an average grain size less than 100 nm.

20. The method according to claim 14, wherein said at least one second size comprises a largest size and a smallest size, said largest size and said smallest size not being equal.

21. The method according to claim 14, wherein said first layer comprises at least one height from said first surface, said at least one height ranging from 0.1 μm to 500 μm.

22. The method according to claim 14, wherein said first layer comprises at least one height from said first surface, said at least one height ranging from 1 μm to 50 μm.

23. The method according to claim 14, wherein said at least one protrusion comprises at least one pyramid, said at least one pyramid comprising three sides or four sides or five sides or six sides.

* * * * *